US007855515B2

(12) United States Patent
Huang et al.

(10) Patent No.: US 7,855,515 B2
(45) Date of Patent: Dec. 21, 2010

(54) HIGH-VOLTAGE HIGH-POWER CONSTANT CURRENT LED DRIVER DEVICE

(75) Inventors: Chaogang Huang, Shenzhen (CN); Yonghong Li, Shenzhen (CN)

(73) Assignee: QX Micro Device Co., Ltd., Shenzhen (CN)

( * ) Notice: Subject to any disclaimer, the term of this patent is extended or adjusted under 35 U.S.C. 154(b) by 384 days.

(21) Appl. No.: 12/178,746

(22) Filed: Jul. 24, 2008

(65) Prior Publication Data

US 2009/0066264 A1 Mar. 12, 2009

(30) Foreign Application Priority Data

Sep. 12, 2007 (CN) ..... 2007 1 0076975

(51) Int. Cl.
*H05B 41/00* (2006.01)

(52) U.S. Cl. ..... 315/185 R

(58) Field of Classification Search ..... 315/185 R, 315/217, 196, 185 S, 209 R, 7; 362/277, 362/800, 126–127
See application file for complete search history.

(56) References Cited

U.S. PATENT DOCUMENTS 6,577,072 B2 * 6/2003 Saito et al. ..... 315/185 R
6,864,641 B2 * 3/2005 Dygert ..... 315/216
7,265,504 B2 * 9/2007 Grant et al. ..... 315/308
7,317,302 B1 * 1/2008 Collins ..... 323/222

* cited by examiner

*Primary Examiner*—Douglas W Owens
*Assistant Examiner*—Minh D A
(74) *Attorney, Agent, or Firm*—Westman, Champlin & Kelly, P.A.

(57) ABSTRACT

A high-voltage high-power constant current LED driver device, can drive LED cluster, comprises switch tube, current sensing resistor Rcs and inductor L, particularly, comprises a low voltage control circuit that detects the voltage drop on the said current sensing resistor Rcs to produce a control signal transmitting to the control terminal of the switch tube; the said current sensing resistor Rcs connects with inductor L in series and is positioned between the output terminal of switch tube and the current output terminal of the current driving device in series connection; the input terminal of the said switch tube is connected to a DC voltage source; and also comprises a diode D3 which the cathode is connected to the output terminal of the said switch tube and anti cathode is grounding. The device of the invention has the advantages of constant current, simple driving circuit and low cost under the high-voltage high-power application.

8 Claims, 3 Drawing Sheets

HIGH-VOLTAGE HIGH-POWER CONSTANT CURRENT LED DRIVER DEVICE

This application claims priority to Chinese Patent Application No. 200710076975.2, filed Sep. 12, 2007, the content of which is incorporated by reference in its entirety.

TECHNICAL FIELD

This invention relates to the power technology of power supply, particularly, to the DC/DC converting devices, and more particularly, to the step-down type constant current LED driver device.

BACKGROUND ART

It should use the constant current power supply to drive the load in some special situations, especially, when the semiconductor illumination source is applied. Taking the high brightness white LED (light-emitting diode) that is developing very fast in illumination components field recently as an example, LED lamps have the advantages of energy saving, long life time, environmental protection and small space occupation and high reliability compared with the traditional illuminating lamps, therefore, the LED lamps have been widely used in the field of illumination, backlight and display. In order to strengthen the above mentioned advantages of white LED, the best way to drive LEDs is to adopt the constant current driver, which enables the current flowing though the LED without being influenced by the variations of voltage and ambient temperature as well as the inconsistency of the parameters of an LED.

Generally, the electric energy comes forth in a form of voltage source in the electric power system, therefore, it is necessary to use a driving circuit (voltage to current converting circuit) to convert voltage VIN into current and then provide it to the load as showed in FIG. 1. Taking driving LED as example, when the voltage of the output terminal, namely the forward voltage VLED on the LED cluster is lower than the voltage of the voltage source, the step-down driving circuit is needed. At present, there are three kinds of the step-down driving circuits;

The first one is to adopt the traditional DC-DC step-down technology as the scheme published on "*Fundamentals of Power Electronics*" ("Fundamentals of Power Electronics", Republished by Kluwer Collage Publishing Housing, 2001) showed in FIG. 2. The switch tube linking in series between the input terminal and output terminal is PMOS, an inductor L is tandem connected between the output terminal of the switch tube and LED, and a current sensing resistor Rcs is connected in series between the LED and the ground and then a capacitor C is in parallel connection with the series subcircuit formed by the said LED and the said current sensing resistor Rcs, the variation of output current is fed back to the switch tube driving circuit through the voltage drop variation of the current sensing resistor Rcs, and the corresponding control signal is produced and transmitted to the gate of the said PMOS, which maintains the slim fluctuation of output current by controlling the switch-on and cut-off of the PMOS to realize the constant current output.

The disadvantages of the circuit are the switch tube driving circuit is complicate and the PMOS has big on-resistance and low efficacy. In addition, the voltage endurance capacity of the switch tube driving circuit should be bigger than the input voltage VIN, and the cost of the switch tube driving circuit will be increased vastly when the high input voltage is applied.

The second one is to adopt the NMOS switch tube to improve the efficiency as the circuit published on product description of ZXLD1350 of Zetex Semiconductor Company showed in FIG. 3. The circuit connects orderly the voltage source VIN, current sensing resistor Rcs, inductor L, LED series and the said NMOS in series and a diode D is in parallel connection with the series subcircuit formed by the current sensing resistor Rcs, inductor L and LED series, and then a switch control circuit of an error comparator with hysteresis is used to compare voltage drop of the said current sensing resistor Rcs with a reference voltage VREF, thus the control signal is produced and transmitted to the gate of the said NMOS to realize the constant current control. The circuit uses the current on the inductor, also the current on the LED at the same, to detect the current and due to the non-abrupt change property of inductor current, the current detection is quite precise; therefore, the constant current performance is quite well. The disadvantages of the circuit are the voltage endurance capacity of the current detection circuit should be bigger than the input voltage VIN because the current detection carries through the high voltage terminal and then the cost of the switch tube driving circuit will be increased vastly when the high input voltage is applied.

The third one is based on the scheme showed in FIG. 3, as the circuit published on product description of HV9910 of Supertex as in FIG. 4. In the circuit, the current sensing resistor Rcs in the tandem loop is moved into the position between the NMOS switch tube and ground lead, a low voltage control circuit is used to replace the said switch control circuit, so as to drive the high voltage switch and the goal of cost reduction is accomplished. The low voltage control circuit comprises an error comparator that receives the voltage drop signal from the said current sensing resistor, and a control circuit to produce the control signal to transmit to the NMOS gate. The disadvantages of the circuit are that only when the NMOS is on the current can be detected and in addition, the constant current performance is not very good because of the charge/discharge affect of stray capacitor $C_{GS}$ of the NMOS.

CONTENT OF THE INVENTION

The technical problem of present invention aiming to settle is to avoid the above-mentioned disadvantages of the prior art and to provide a LED constant current driving device that can maintain the constant current effect in the high voltage and high power application and simplify the design of driving circuit.

The said technical problem can be solved by this invention via providing a high-voltage high-power constant current LED driving device that comprises switch tube, current sensing resistor Rcs and inductor L, particularly, comprises a low voltage control circuit that detects the voltage drop on the said current sensing resistor Rcs to produce a control signal transmitting to the control terminal of the switch tube; the said current sensing resistor Rcs connects with inductor L in series and is positioned between the output terminal of switch tube and the current output terminal of the current driving device in series connection; the input terminal of the said switch tube is connected to a DC voltage source; and also comprises a diode D3 which the cathode is connected to the output terminal of the said switch tube and anti cathode is grounding.

In the solution mentioned above, there is the LED cluster consisting of multi-LEDs tandem connects between the current output terminal of the constant driving device and ground.

In the solution mentioned above, the said switch tube is a NMOS tube and the output terminal of the switch tube is the source electrode of said NMOS and the input terminal is the drain electrode of said NMOS.

In the solution mentioned above, the low voltage control circuit comprises a comparator with hysteresis and the inverted input terminal of which is linked with the terminal of the said current sensing resistor Rcs near to the output terminal of switch tube, and the non-inverting input terminal is linked with the anode of a reference voltage source VREF and the cathode of the said reference voltage source VREF is connected to another terminal of the said current sensing resistor Rcs; and the said comparator outputs a control signal transmitting to the control terminal of the said switch tube.

In the solution mentioned above, the power supply of the said low voltage control circuit is from the said DC voltage source, and in details, a diode D1, resistor R and Zener diode D2 is connected in series between the said DC voltage source and the output terminal of the said switch tube, the cathodes of diode D1 and of Zener diode D2 are connected to the said resistor; the base of a transistor is connected to the cathode of the said Zener diode D2, the collector is connected to the cathode of diode D1 and the emitter is connected to anticathode of the said Zener diode D2 via a capacitor C; the anticathode of the said Zener diode D2 is also connected to the cathode of the said diode D3, and thus the capacitor C can provide the said power supply to the low voltage control circuit by charging and discharging.

With the technical solutions mentioned above, the cost of the driving device can be reduced.

DETAILED IMPLEMENTATION OF THE INVENTION

An elaborated illustration based on the preferred embodiments as shown in the attached figures is provided as below.

Figure 5:
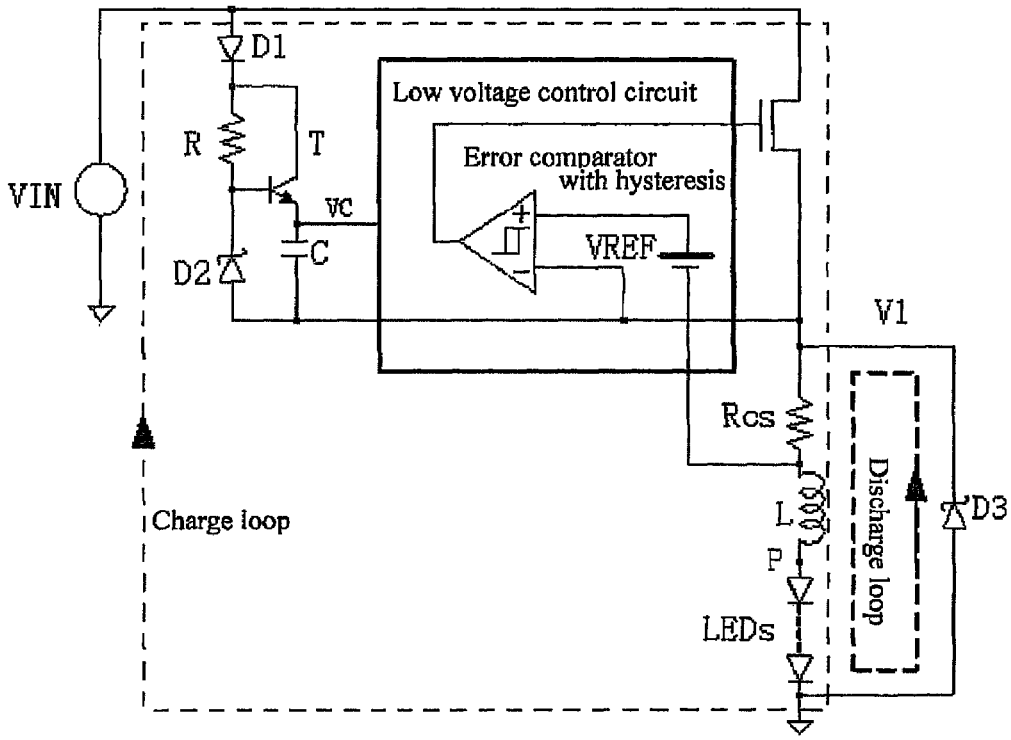
FIG. 5 is the electrical principle diagram of the constant current driving device of present invention.

Showed as the electrical principle diagram of FIG. 5, the constant current driving device of present invention comprises a switch tube with an input terminal linking to a DC Voltage source VIN; a current sensing resistor Rcs that is connected with inductor L and also connected in series between the output terminal of the said switch tube and the current output terminal P of the current driving device; the cathode of the said diode D3 is linked to the output terminal of said switch tube and the anticathode is grounding. In present invention the constant current driving device also comprises a low voltage control circuit that detects the voltage drop on the said current sensing resistor Rcs to produce a control signal transmitting to the control terminal of the switch tube. The said DC voltage source can be obtained by rectification and wave filtering via AC power supply. And the said DC voltage power can also be obtained from an external power supply module and then provided to the device of present invention via connecting terminals.

In the best implementation of device of present invention, the said low voltage control circuit comprises a comparator with hysteresis and the inverted input terminal of which is linked with the terminal of the said current sensing resistor Rcs near to the output terminal of switch tube, and the non-inverting input terminal is linked with the anode of a reference voltage source VREF and the cathode of the said reference voltage source VREF is connected to another terminal of the said current sensing resistor Rcs; and the said comparator outputs a control signal transmitting to the control terminal of the said switch tube. This low voltage control circuit can also adopt other forms, comprising the low voltage switch control circuit similar to that showed in FIG. 4, however, because it is the existing technology and has more complicate structure, it will not be exemplified in this invention.

The said switch tube adopts, but not limit to, the NMOS showed in the figures, however, in order to improve the converting efficiency of the driving device, the best way is to adopt NMOS with low on-resistance. The output terminal of said switch tube is the source electrode of the NMOS and the input terminal is the drain electrode of the NMOS. Fast recovery diodes or schottky diodes has been recommended for the said diode D3 in prior art.

Taking the load as LED as an example, there is the LED cluster consisting of multi-LEDs in series connection between the said current output terminal P and ground, the principle of the device of present invention is as follow, when the switch tube is on, the input voltage VIN charge the inductor L via the charge loop of NMOS, resistor Rcs, inductor L and LED cluster, and if the voltage drop on NMOS and resistor Rcs is ignored, the voltage on the inductor L is VIN−VLED and the current ascending gradient of the inductor is (VIN−VLED)/L, when the current is up to VREF/Rcs, the hysteretic comparator outputs the low level and the NMOS switch tube is switched off. When the switch tube is switched off, the inductor L release the electric charge via the discharge loop of inductor L, LED cluster, diode D3 and current sensing resistor Rcs and if the voltage drop on resistor Rcs and diode D3 is ignored, the voltage of inductor L is −VLED, the descending gradient of inductor current is −VLED/L, when the current is declined to (VREF−ΔVREF)/Rcs, wherein, ΔVREF is the hysteretic voltage of the comparator with hysteresis, the comparator outputs the high level and the NMOS switch tube is switched on. The above said On-off process will be repeated constantly, so as to provide the DC power to the load.

Figure 6:
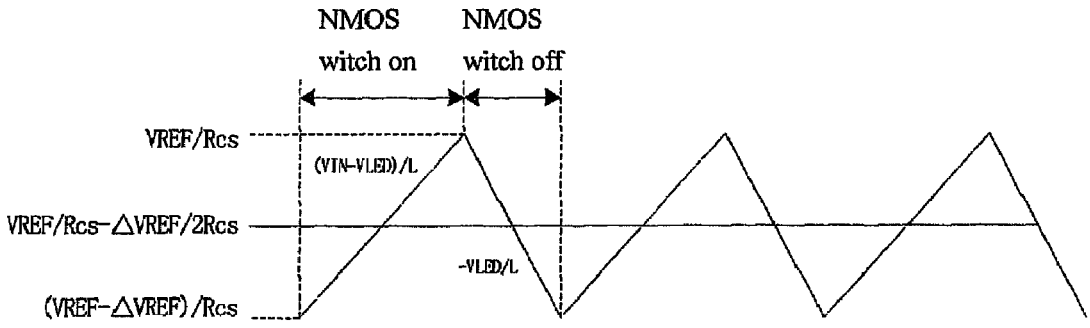
FIG. 6 is the schematic drawing of output current of the device showed in FIG. 5.

FIG. 6 shows the current on the inductor L in the repeat process mentioned above, namely, the waveform of the current output by the device of the invention. The waveform is serrasoid, the maximum current value is VREF/Rcs, the minimum is (VREF−ΔVREF)/Rcs, and the mean is VREF/Rcs−ΔVREF/2Rcs and the varying range is ΔVREF/Rcs. The average current of the device of the invention relates to the VREF, Rcs and ΔVREF and is independent to input voltage VIN; the varying range of current is mainly dependent on ΔVREF/Rcs; the device of the invention can set the value of current through setting the Rcs and ΔVREF according to the load and can reduce the ripple of current at large to realize the constant current driving.

Figure 1:
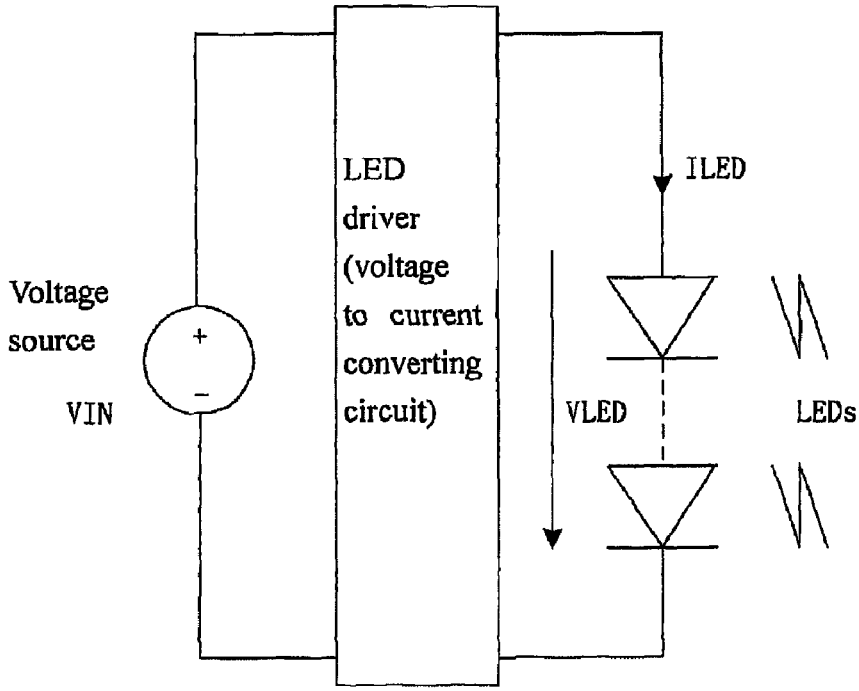
FIG. 1 is the function block diagram of existing current driving circuit.
Figure 2:
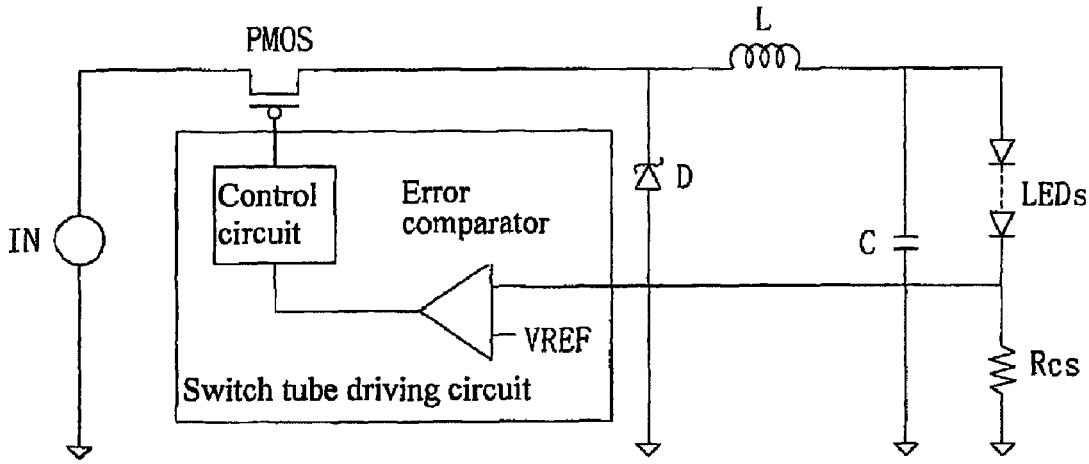
FIG. 2 is the electrical principle diagram of the embodiment 1 of existing current driving circuit.
Figure 3:
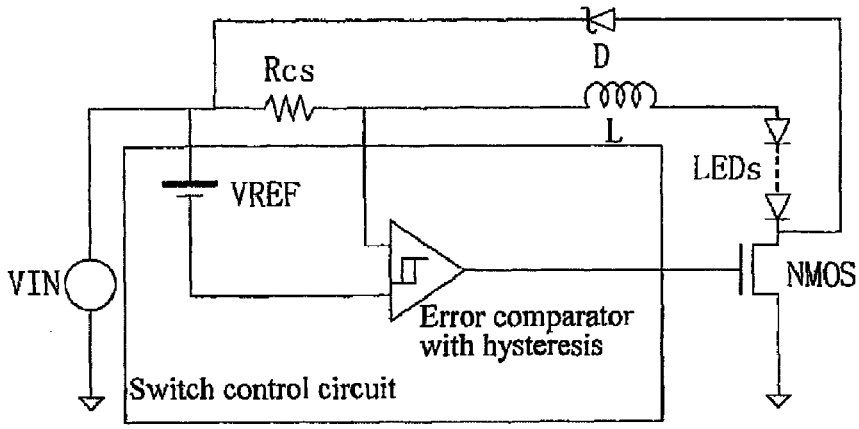
FIG. 3 is the electrical principle diagram of the embodiment 2 of existing current driving circuit.
Figure 4:
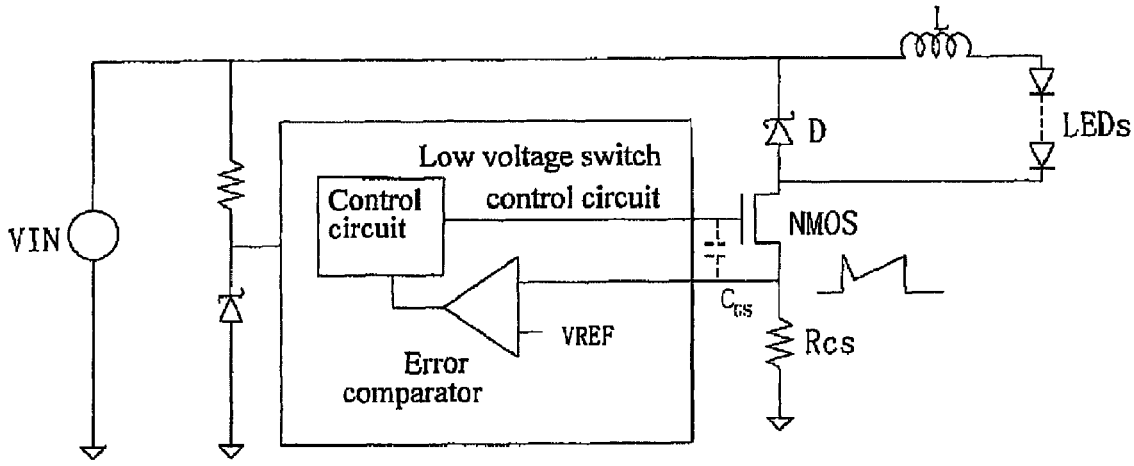
FIG. 4 is the electrical principle diagram of the embodiment 3 of existing current driving circuit.

For the device of the invention, the power supply of said low voltage control circuit can adopt a form similar to that showed in FIG. 4, which is obtained from the DC voltage source VIN through a resistor with a voltage stabilizing diode. FIG. 5 shows the optimal embodiment of the power supply: a diode D1, resistor R and Zener diode D2 is connected in series between the DC voltage source and the output terminal of the said switch tube, the cathodes of diode D1 and of Zener diode D2 are connected to the said resistor; the base of a transistor (including but not limit to transistor) T is connected to the cathode of the said Zener diode D2, the collector is connected to the cathode of diode D1 and the emitter is connected to anticathode of the said Zener diode D2 via a capacitor C; the anticathode of the said Zener diode D2 is also connected to the cathode of the said diode D3. Thus when the switch tube is off, if the forward voltage drop of the diode D3 is ignored, the voltage at the anticathode of Zener diode D2 (as V1 showed in figure) is zero, the DC voltage source VIN charges capacitor C via the diode D1 and transistor T, the voltage on capacitor C (as the voltage at VC position) is VD2−VBE (wherein VD2 is the voltage drop of the Zener diode D2 and VBE is the on voltage drop of the BE junction of the transistor T). The resistor R has the function of limiting the current. When the switch tube is switched on, and if the voltage drop of the switch tube is ignored, the voltage at V1 is VIN and the instant voltage at VC is VIN+VD2−VBE, the diode D1 is reverse cut-off and the capacitor C will release the electric power to the said low voltage control circuit. Thus, the device of the invention can be applied to wider VIN input range by supplied the power to the low voltage control circuit from VC, and the power supply is more stable and power consumption is lower.

The invention claimed is:

1. A high-voltage high-power constant current LED driver device, comprises switch tube, current sensing resistor Rcs and inductor L, the device further comprising:

also comprises a low voltage control circuit that detects a voltage drop on the said current sensing resistor Rcs to produce a control signal transmitting to a control terminal of the switch tube; the a current sensing resistor Rcs connects with an inductor L in series and is positioned between the output terminal of the switch tube and a current output terminal of a current driving device in a series connection; an input terminal of the said switch tube is connected to a DC voltage source;

a diode D3 having a cathode connected to the output terminal of the said switch tube and a diode D3 having a cathode is grounded; and the low voltage control circuit which detects the voltage drop on the current sensing resistor Rcs by using a comparator connected to the current sensing resistor Rcs; the low voltage control circuit output a control signal to the control terminal of the switch tube; the current sensing resistor Rcs connects with the inductor L in series and is positioned between the output terminal of the switch tube and the current output terminal of the current driving device in a series connection; the input terminal of the switch tube is connected to a DC voltage source.

2. According to claim 1, the said high-voltage high-power constant current LED driver device comprises: a LED cluster consisting of multi-LEDs tandem connected between the current output terminal of the said driving device and ground.

3. According to claim 1, the high-voltage high-power constant current LED driver device, wherein the DC voltage power is obtained from an external power supply module and then provided to the device via connecting terminals.

4. According to claim 1, the said high-voltage high-power constant current LED driver device, wherein the switch tube is a NMOS tube and the output terminal of the switch tube is the source electrode of said NMOS and the input terminal is the drain electrode of said NMOS.

5. According to claim 1, the high-voltage high-power constant current LED driver device, wherein the low voltage control circuit comprises a comparator with hysteresis and the inverted input terminal is linked with the terminal of the current sensing resistor Rcs near to the output terminal of switch tube, and the non-inverting input terminal is linked with the anode of a reference voltage source VREF and the cathode of the reference voltage source VREF is connected to another terminal of the resistor Rcs; and the comparator outputs a control signal transmitting to the control terminal of the switch tube.

6. According to claim 5, the said high-voltage high-power constant current LED driver device, wherein a power supply of the low voltage control circuit is from the said DC voltage source, a diode D1, resistor R and Zener diode D2 are connected in series between the DC voltage source and the output terminal of the switch tube, the cathodes of diode D1 and of the Zener diode D2 are connected to the resistor; the base of a transistor is connected to the cathode of the Zener diode D2, the collector is connected to the cathode of diode D1 and the emitter is connected to anticathode of the Zener diode D2 via a capacitor C; the anticathode of said voltage stabilizing diode D2 is also connected to the cathode of the Zener diode D3, and the capacitor C provides the power supply to the low voltage control circuit by using the charge and discharge recycle.

7. According to claim 5, the high-voltage high-power constant current LED driver device, wherein a varying range of the output current of said device is dependent on ΔVREF/Rcs wherein ΔVREF is a hysteretic voltage of the comparator with hysteresis.

8. According to claim 1, the said high-voltage high-power constant current LED driver device, wherein the diode D3 is a schottky diodes.

* * * * *